United States Patent [19]

Jansz

[11] 4,063,599

[45] Dec. 20, 1977

[54] METHOD AND APPARATUS FOR UNDERWATER PILE DRIVING

[75] Inventor: Joost W. Jansz, The Hague, Netherlands

[73] Assignee: Hollandsche Beton Groep N.V., Rijswijk, Netherlands

[21] Appl. No.: 687,493

[22] Filed: May 18, 1976

[30] Foreign Application Priority Data

May 21, 1975 Netherlands ..... 7505975

[51] Int. Cl.[2] ..... E02D 5/34

[52] U.S. Cl. ..... 173/1; 173/DIG. 1; 61/53.5

[58] Field of Search ..... 61/53.5; 173/1, 128, 173/130, 132, DIG. 1; 175/6

[56] References Cited

U.S. PATENT DOCUMENTS

| | | | |
|---|---|---|---|
| 26,073 | 11/1859 | Whipple | 175/6 |
| 3,353,362 | 11/1967 | Lubinski | 173/1 X |
| 3,491,842 | 1/1970 | Delacour et al. | 175/6 |
| 3,714,789 | 2/1973 | Chelminski | 173/1 X |

FOREIGN PATENT DOCUMENTS

| | | | |
|---|---|---|---|
| 2,243,309 | 3/1973 | Germany | 173/DIG. 1 |
| 24,919 | 8/1901 | Switzerland | 61/53.5 |
| 926,096 | 5/1963 | United Kingdom | 173/132 |
| 156,107 | 12/1963 | U.S.S.R. | 61/53.5 |

*Primary Examiner*—Lawrence J. Staab
*Attorney, Agent, or Firm*—Sughrue, Rothwell, Mion, Zinn and Macpeak

[57] ABSTRACT

Underwater pile driving is implemented by a pile-driving apparatus 14 releasably coupled to a guide sleeve 5 secured to the top of a pile 10. The assembly may be performed on the surface vessel 1 through an opening 4 in a laterally extending platform 2 with the aid of a crane 13, or underwater. The components are lowered on guide cables 8, 9, and after the driving operation is completed, the coupled apparatus 14 and sleeve 5 are raised together. The striking plate 22 for the pile-driving hammer is carried by the apparatus 14.

7 Claims, 5 Drawing Figures

METHOD AND APPARATUS FOR UNDERWATER PILE DRIVING

BACKGROUND OF THE INVENTION

1. Field of the Invention

This invention relates to a method and apparatus for underwater pile driving featuring a ship or barge provided with lifting means for lowering a pile and for manipulating a pile-driving device. The latter comprises a casing with a vertically movable pile hammer disposed therein, means for driving the pile hammer, and a striking plate disposed in the lower part of the casing. A sleeve member is positioned below the striking plate and is adapted to fit on the upper end of the pile.

2. Description of the Prior Art

Devices of this general type are disclosed in U.S. Pat. No. 3,828,866 and published German patent application No. 2,243,309, for example. Both of these pile-driving devices are provided with a sleeve member which may be positioned on the upper end of the pile, whereby the pile and the pile-driving device form an integral part and the pile is driven into the ground when the device is in operation.

Considerable difficulties arise when the pile-driving takes place at considerable depths, however, particularly when long piles have to be handled which are built up of a plurality of joined sections.

SUMMARY OF THE INVENTION

In accordance with the present invention, a casing and guide sleeve member are detachably connected to each other and locked via a quick-acting coupling. The sleeve member may be supported independently of the casing in the floating ship at a region concentric with the center line of the path of the pile, said unit being provided with flexible guide means running from the unit parallel to the center line of the path of the pile towards the place where pile-driving has to be carried out. The guide means co-operate with guide eyes or the like on the pile and the sleeve member.

The pile sections can be assembled in and through the sleeve member which is supported in the ship. When the pile with the guide sleeve at its top has thus been assembled, it is possible to position the pile-driving apparatus on the sleeve member, the pile-driving apparatus being present near the region where the pile is assembled, and to then lower the entire unit for operation. It is also possible to first lower the assembly of the pile and sleeve member, and have the pile-driving apparatus follow later. In doing so, one may use guide means which carry the pile themselves, as suggested in U.S. application Ser. No. 588,554. However, it is also possible to use flexible guide cables running towards a structure positioned on the sea bed, said structure being provided with means for receiving the pile, in which the guide cables are secured to the structure at either side of the pile receiving means. Even then, it is possible to first lower the pile and sleeve member and to subsequently lower the pile-driving device, or to simultaneously lower the entire assembly of the pile, sleeve member and pile-driving apparatus via the guide cables. The sole function of the guide cables is to insure that all parts moved downwards reach their proper position.

Whereas with the known pile-driving apparatuses the pile cap consists of a sleeve member embracing the pile head and a striking plate forming an integral part therewith, the proposal according to this invention contemplates a division of this structure whereby the striking plate is part of the pile-driving apparatus and the sleeve member, when disconnected from the pile-driving apparatus, serves the function of guide means.

The casing and sleeve member are preferably provided with means for centering the casing on top of the sleeve member during coupling.

The disconnection of the sleeve member and pile-driving apparatus also has the advantage that one can operate with several supports for sleeve members at different locations on the ship. It is thus possible during the process of pile-driving to carry out preliminary work at other locations, which results in the more efficient use of the pile-driving apparatus.

When the pile is being built up of separate sections, each pile section positioned in the sleeve must be held to prevent it from falling down into the sea and to enable the next section to be secured on top of it, e.g. by welding. The holding may be implemented in any suitable way, as by clamping means secured to the ship which grip the pile at a suitable level above or below the sleeve. When disposed below the sleeve, it must be possible that the clamping means may be moved entirely outside the path of the guide means.

BRIEF DESCRIPTION OF THE DRAWINGS

The invention will now be described more in detail with reference to the accompanying drawings, wherein.

DESCRIPTION OF THE PREFERRED EMBODIMENT

Figure 2:
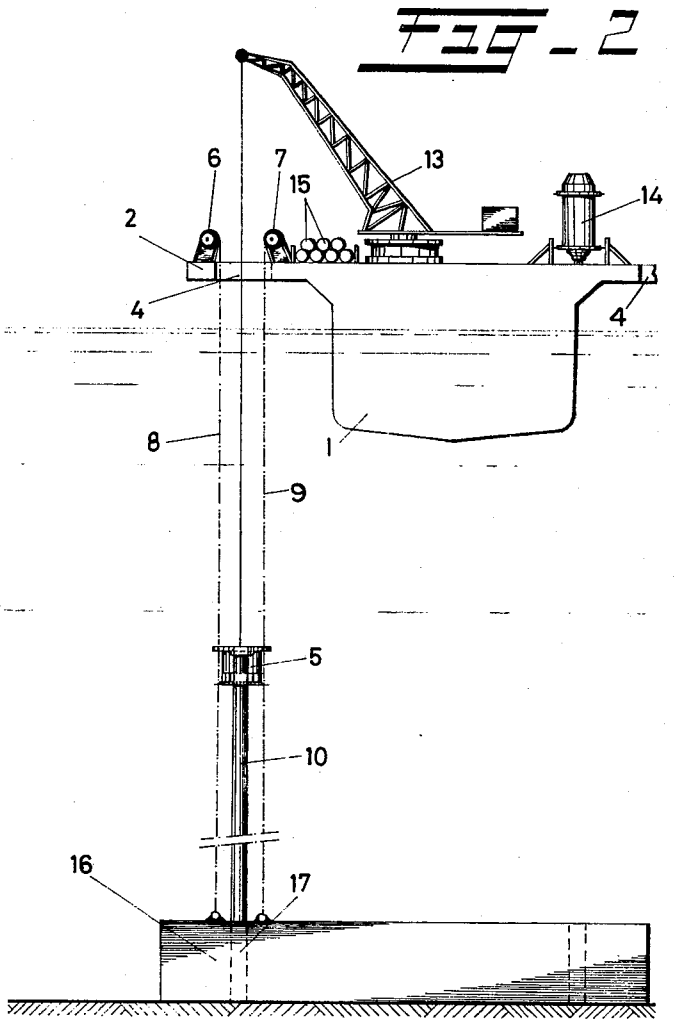
FIGS. 1, 2 and 3 are diagrammatic representations of the apparatus of the invention in sequential stages of operation.
Figure 1:
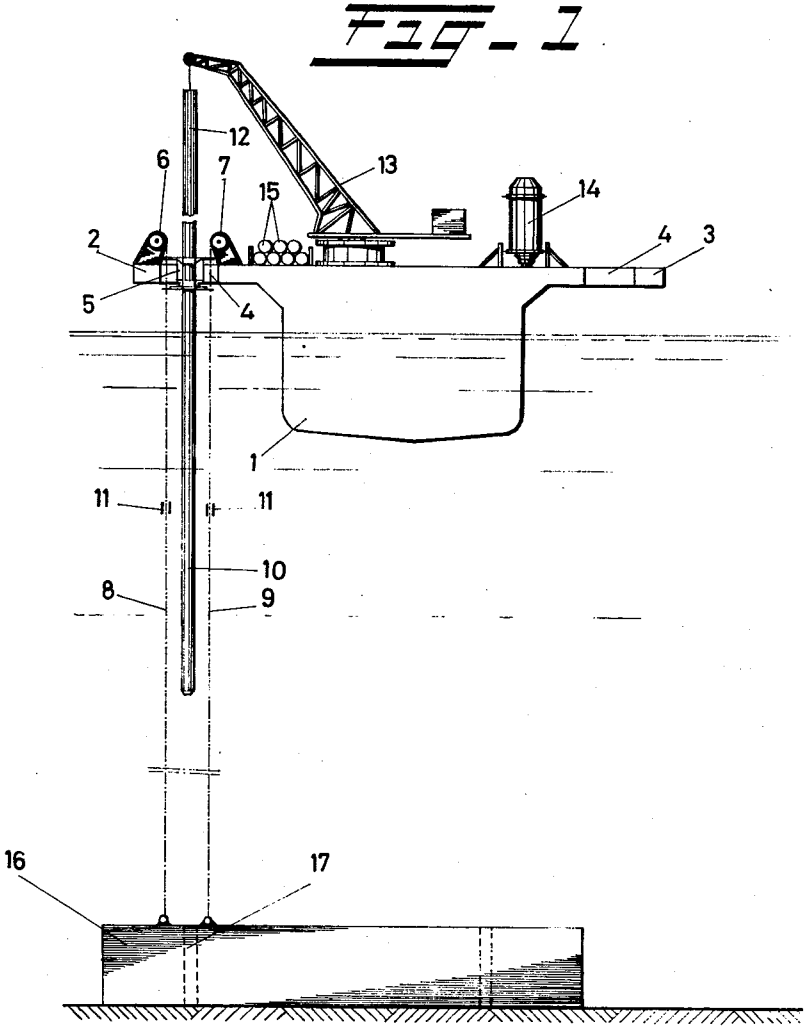
Figure 3:
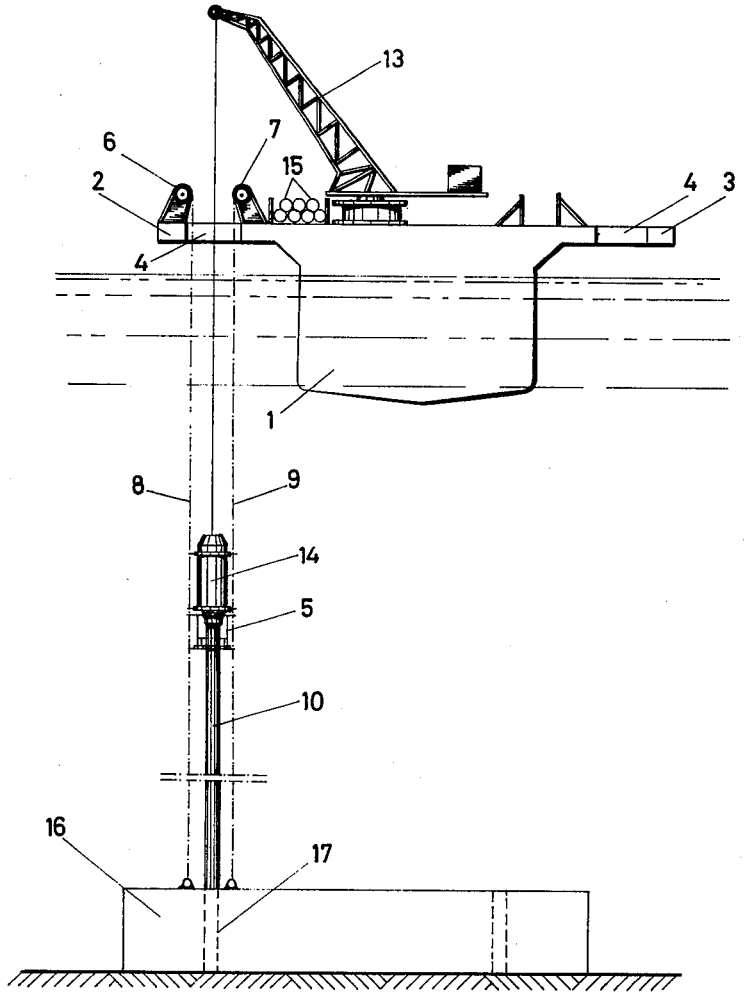

FIGS. 1, 2 and 3 illustrate a vessel 1 provided with laterally projecting work platforms 2 and 3, each platform having an opening 4 in which a sleeve member 5 may be positioned, said sleeve member adapted to fit on the top of a pile. Winches 6 and 7 for guide ropes 8 and 9 are positioned on either side of the opening 4.

In FIG. 1 a pile 10 has been positioned in the sleeve member 5, the pile being guided on cables 8 and 9 by guide eyes 11 and being held by means not illustrated. A further pile section 12, which must be connected to pile 10, is suspended over the top of the pile string. The suspension and connection is performed with the aid of a hoisting crane 13. This crane can be used also for lifting the pile-driving apparatus 14 and for positioning same on sleeve 5.

FIG. 2 shows the pile 10 lowered with the sleeve 5 on top of it. In FIG. 2 the pile-driving apparatus 14 has still to be lowered to its operating position, which may be done with the aid of hoisting crane 13 and guide cables 8 and 9.

FIG. 3 illustrates the position obtained when the pile-driving apparatus 14 has been lowered onto the sleeve 5 and/or has been lowered in combination therewith.

When the pile-driving process has been completed the pile-driving apparatus and the sleeve 5 are raised together, the sleeve is supported again in the opening 4 of the platform 2, the connection between the sleeve 5 and the pile-driving apparatus 14 is released, and the pile-driving apparatus is put aside again so that the next pile can be assembled. The pile sections may be stored on deck in a stack 15.

In the illustrated embodiment, guide cables 8 and 9 are secured to a caisson 16 lowered to the ocean floor on either side of a sleeve or duct 17 through which the pile 10 may be inserted into the ground and, thus, can also be kept in an upright position after having been lowered.

Figure 4:
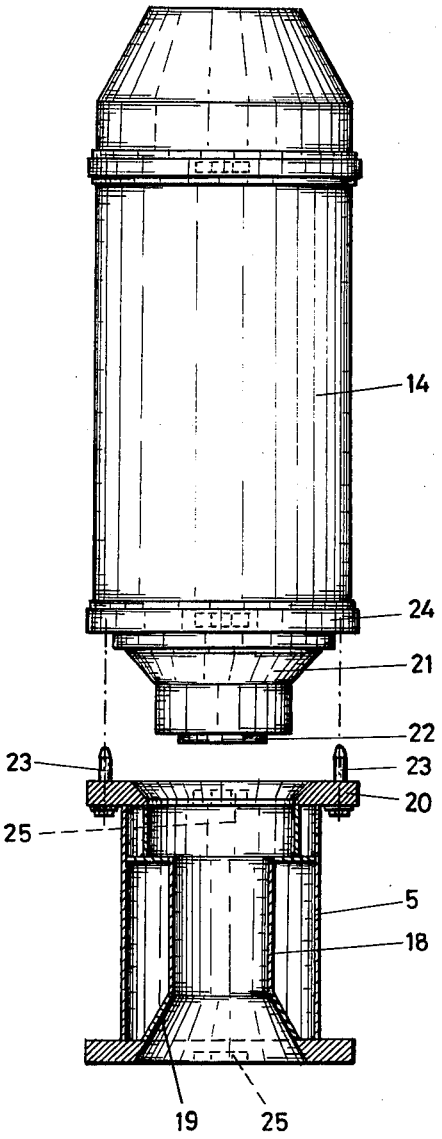
FIG. 4 is a lateral view of the pile-driving device and the sleeve member in an aligned but separated position.
Figure 5:
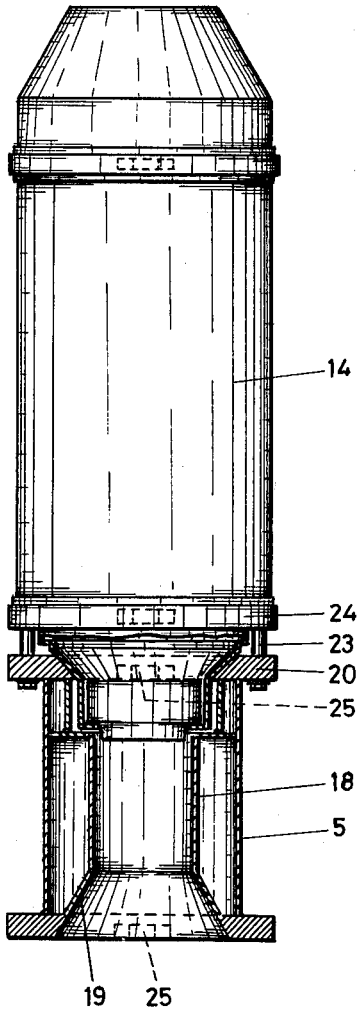
FIG. 5 shows the pile-driving device and the sleeve member in a coupled condition.

FIG. 4 is an elevational view of the pile-driving apparatus 14 disconnected from the guide sleeve 5. The sleeve has an internal guide casing 18 having a conically expanding lower mouth opening 19. A ring 20 is secured on top of the casing, said ring also having a concial aperture for centering the lower section 21 of the pile-driving apparatus 14, in which the striking plate 22 has been accommodated. The ring 20 is provided with pins 23 which cooperate with bores in the edge 24 of the casing of the pile-driving apparatus 14. The pins may be secured in the bores by transverse locking pins, for example (not illustrated). The guide elements for cables 8 and 9 have been indicated by reference numerals 25.

I claim:

1. In an apparatus for underwater piledriving including a surface vessel having lifting means for lowering a pile and for manipulating a pile-driving apparatus, said pile-driving apparatus comprising a casing with a vertically movable pile hammer disposed therein, means for driving said pile hammer and a striking plate, said plate being disposed in the lower part of the casing, said casing below the striking plate being provided with a sleeve member, said member adapted to fit on the upper end of the pile, the improvement comprising: a quick-acting coupling device for detachably connecting and locking said sleeve member and said casing, and wherein the sleeve member may be supported independently of the casing by the vessel at a region concentric with the center line of the path of the pile, said vessel being provided with flexible guide means, said guide means running from the vessel parallel to the center line of the path of the pile towards the sea bed location where the pile is to be driven, and the guide means cooperating with guide eyes on the pile and the sleeve member.

2. An apparatus in accordance with claim 1, characterized in that the flexible guide means runs towards a structure positioned on the sea bed, said structure having a passage therethrough for receiving the pile, the guide means being secured to the structure on either side of said passage.

3. An apparatus in accordance with claim 1 characterized in that the vessel has a plurality of support points for sleeve members.

4. An apparatus in accordance with claim 1, characterized in that the vessel has clamping means for holding a pile inserted in a sleeve member.

5. A method of application of the apparatus defined in claim 1 wherein the pile is assembled of sections, characterized in that each time a second section is positioned on top of and secured to a first section of the pile already positioned in the sleeve, which first section has been lowered through the sleeve to such an extent that its upper part projects above the sleeve, after securing the last section, the completed pile is lowered so far that its upper end is positioned in the sleeve, and subsequently the pile-driving apparatus is positioned onto the assembly of the pile and sleeve member.

6. A method as defined in claim 5 wherein the pile and sleeve member assembly is first lowered to the sea bed and the pile-driving apparatus is thereafter lowered into the sleeve member and coupled thereto.

7. A method as defined in claim 5 wherein the pile-driving apparatus is lowered into the sleeve member and coupled thereto on the surface, and the overall assembly of the pile, the sleeve member and the pile-driving apparatus is thereafter lowered to the sea bed.

* * * * *